US005420555A

United States Patent [19]

Toguchi et al.

[11] Patent Number: 5,420,555

[45] Date of Patent: May 30, 1995

[54] PLURAL SEALED CONTACT UNITS WITH COMMON ELECTROMAGNETIC OPERATING MECHANISM

[75] Inventors: Takehiko Toguchi; Hideya Kondo; Mamoru Tateno; Yoichi Yokoyama; Hirofumi Fukazawa; Riichi Uotome; Kiyoshi Goto, all of Kadoma, Japan

[73] Assignee: Matsushita Electric Works, Ltd., Osaka, Japan

[21] Appl. No.: 82,335

[22] Filed: Jun. 24, 1993

[30] Foreign Application Priority Data

Jun. 25, 1992 [JP] Japan ..... 4-167636
Oct. 30, 1992 [JP] Japan ..... 4-293367
Nov. 25, 1992 [JP] Japan ..... 4-314969

[51] Int. Cl.[6] ..... H01H 1/66; H01H 3/00

[52] U.S. Cl. ..... 335/185; 200/243; 335/202; 218/1

[58] Field of Search ..... 200/16 A, 243, 144 R, 200/144 A, 144 B, 144 C, 144 AP, 147 R, 147 A, 148 R, 148 A, 148 B, 148 F; 335/185-202

[56] References Cited

U.S. PATENT DOCUMENTS 2,929,903 3/1960 Fillette ..... 200/243
3,845,263 10/1974 Dickinson ..... 200/144 B X
4,153,827 5/1979 Mircovich et al. ..... 200/144 B
4,306,123 12/1981 Taylor ..... 200/16 A
4,513,181 4/1985 Boysen et al. ..... 200/50 C
4,638,275 1/1987 Belbel et al. ..... 335/151
4,866,227 9/1989 Toguchi et al. ..... 200/147 A
4,924,040 5/1990 Orrico ..... 200/16 A

*Primary Examiner*—J. R. Scott
*Attorney, Agent, or Firm*—Kenyon & Kenyon

[57] ABSTRACT

A sealed contact unit that attains stabilized contact switching operation and effective dimensional minimization with an arrangement wherein a switching contact section including opposing movable and stationary contacting members is housed within a sealed container together with an electrically insulating gas, a movable shaft interlocked to the movable contacting member is hermetically passed through a wall of the container to be axially shiftable with an end projected externally while the movable contacting member biased away from the stationary contacting member by a resetting spring is mounted through a contact-pressure spring to the other end of the movable shaft inside the container, the contact-pressure spring being provided to coaxially enclose the movable shaft and biasing the movable contacting member against the biasing force of the resetting spring for attaining a contact-pressure when the movable contact member shifts to engage the stationary contact member fixed inside the container, a driving section for switching ON and OFF between movable and stationary contacts of the movable and stationary contacting members is engaged to the projected end of the movable shaft for axial drive of the shaft.

9 Claims, 6 Drawing Sheets

PLURAL SEALED CONTACT UNITS WITH COMMON ELECTROMAGNETIC OPERATING MECHANISM

BACKGROUND OF THE INVENTION

This invention relates to sealed contact units and, more particularly, to a sealed contact unit which finds its utility when employed in power loading relays, electromagnetic switches and the like.

DESCRIPTION OF RELATED ART

For the sealed contact units of the kind referred to, there has been suggested in, for example, U.S. Pat. No. 4,638,275 to Elie Belbel et al, an electric switching device employing a sealed contact unit, which device comprises a sealed container having an electrically insulating gas, a sealed contact section sealed in the container and having movable and stationary contacts and a movable shaft for moving at an axial end the movable contact and disposed at the other end in an outward projected part of the container, and an electromagnet section having exciting coils wound about the projected part of the container for actuating a movable core within the projected part and interlocked to the other end of the movable shaft so as to axially drive the movable shaft to open and close the contacts.

In the above sealed contact section, a stationary contacting member to which the stationary contacts are secured is held between the sealed container and a body member of the device, to which base the container and contacting member are fastened through O-rings, while the movable shaft carries at the one end a movable contacting member to both ends of which the movable contacts are secured and at the other end the movable core which is biased by a coil spring normally in contact opening direction. In one aspect, in contrast to the above described aspect in which the movable core of the electromagnet section is disposed within the sealed container, the movable shaft of the sealed contact section is shaped to have a larger diametered portion is passed through a guiding through hole made, as adapted to the shape of the movable shaft, in the body to dispose the movable core of the electromagnet section to be below the body while air-tightly sealing a peripheral clearance about the movable shaft by means of a ring diaphragm secured at outer peripheral edge to the bottom face of the body and at inner peripheral edge to the outer periphery of the movable shaft, so that the movable shaft carrying the movable core disposed below the body of the sealed container will be axially movable while keeping the interior of the container in the air-tightly sealed state. In the electromagnet section in this case, the exciting coil is wound on a bobbin disposed about a central upward part of a stationary core E-shaped in central sectional view, the movable core likewise E-shaped in the central sectional view is in the position opposed to the stationary core.

In the electric switching device disclosed in Belbel et al, therefore, the coil excitation causes the movable core to be attracted to the stationary core, with the movable shaft interlocked to the movable core axially moved as guided by the through hole of the body of the sealed casing, so as to bring the movable contacts into engagement with the stationary contacts while being subjected to a load of a contacting member spring. When, on the other hand, the coil is deenergized, the movable shaft and movable core are returned to the original position by means of a resetting spring, and the movable contacts are separated from the stationary contacts.

In employing the foregoing sealed contact unit of Belbel et al, its switching operation of the contacts carried out within the electrically insulating gas renders the unit to be useful when employed in the power loading relay. In this sealed contact unit, however, a stable contact switching operation of the contacts requires that the movable core is attracted to the stationary core at a high positional precision and the movable shaft moves axially smoothly without any bumby motion. In this respect, the movable and stationary cores are provided as mutually separate members, and there arises a problem that the stationary core may happen to involve a positional deviation in right angle directions with respect to the moving direction of the core. Since the movable core is attracted to the stationary core with any magnetic loss rendered to be the minimum, the positional deviation may cause a risk to arise in that the movable shaft is thereby caused to collide with peripheral wall of the guiding through hole in the body so as not to be smoothly guided by the hole without being optimumly driven in its axial direction. While it may be possible to enlarge the diameter of the guiding through hole for the purpose of avoiding such risk with a relatively large clearance between the outer periphery of the movable shaft and the inner periphery of the through hole, for example, this will cause another problem to arise in that expected guiding function of the through hole with respect to the movable shaft is lowered to have the movable shaft not moved linearly in the axial direction and thus any sufficiently stable switching motion of the contacts cannot be assured. In such known switching device of the type referred to, further, the contact pressure spring, axially movable shaft, movable core, resetting spring and, as required, sealing diaphragm are required to be disposed substantially in linear relationship, and there is involved a problem that the device has to be kept excessively large in the entire height.

SUMMARY OF THE INVENTION

Accordingly, a primary object of the present invention is to provide a sealed contact unit which assured in particular the linear motion of the movable shaft along its axis, so as to be capable of attaining a stable contact switching operation, a remarkably improved reliability of the contact switching operation, and an effective realization of dimensional minimization with the entire height of the device reduced.

According to the present invention, this object can be realized by means of a sealed contact unit in which a sealed container defining therein an air-tightly sealed space with a bellows mounted thereto and an electrically insulating gas sealed therein houses a switching contact means including movable and stationary contacting members to which movable and stationary contacts are respectively secured and a movable shaft interlocked at an end to the movable contacting member and projected at the other end out of the container through the bellows in air-tight manner to be interlocked at the projected end to a driving means for switching the movable and stationary contacts, and the movable contacting member is subjected to biasing forces of a contact-pressure spring acting in a direction of closing the movable and stationary contacts and of a resetting spring acting in the other direction of opening the movable and stationary contacts, wherein the contact pressure spring as well as the bellows are disposed to coaxially enclose the movable shaft.

Other objects and advantages of the present invention shall become evident as following description of the invention advances as detailed with reference to preferred embodiments of the invention shown in accompanying drawings.

While the present invention should now be described with reference to the embodiments shown in the accompanying drawings, it should be appreciated that the intention is not to limit the invention only to these embodiments shown but rather to include all alterations, modifications and equivalent arrangements possible with the scope of appended claims.

DETAILED DESCRIPTION OF THE PREFERRED EMBODIMENTS

Figure 1:
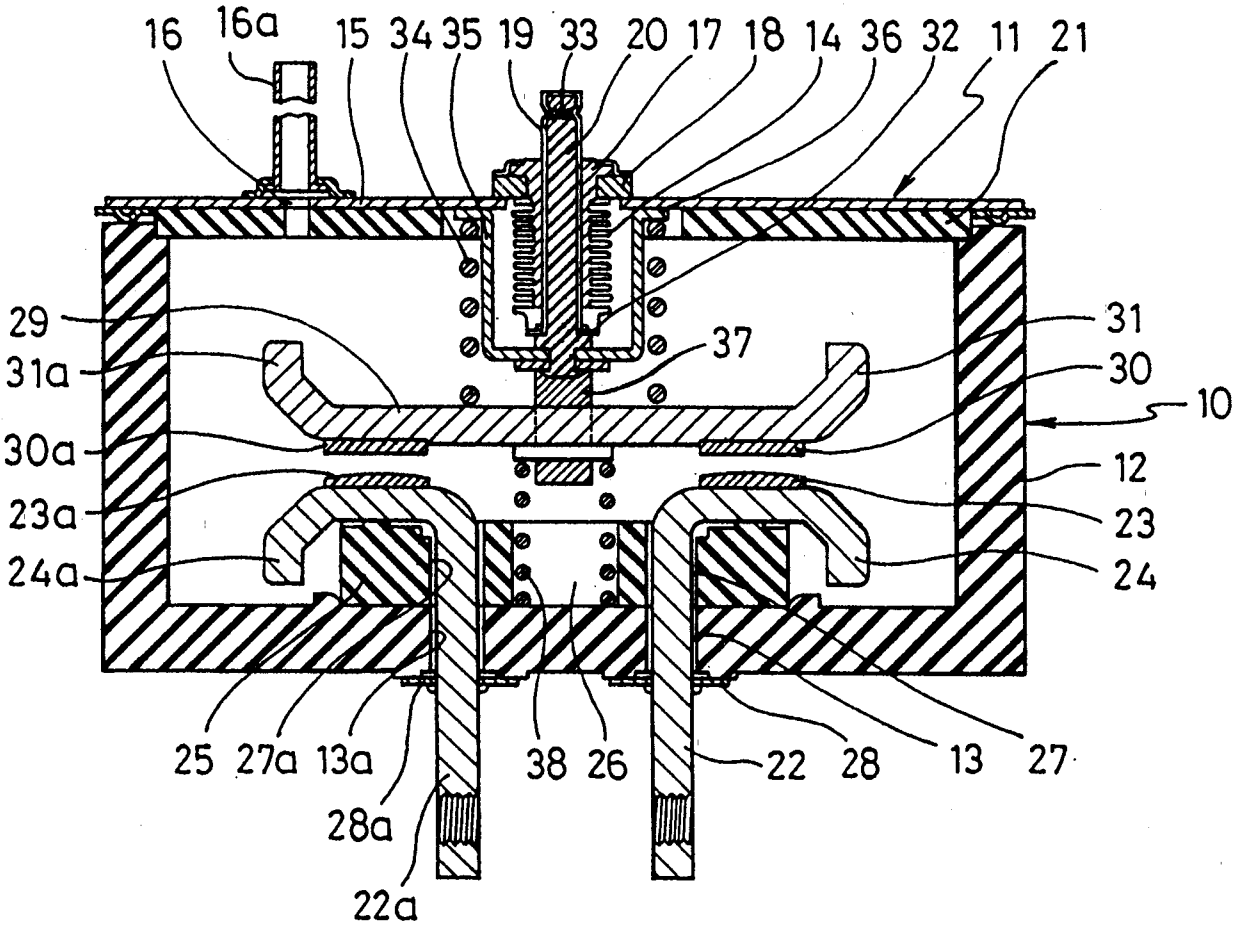
FIG. 1 shows in a vertically sectioned view an embodiment of a sealed switching contact means employed in the sealed contact unit according to the present invention.
Figure 3:
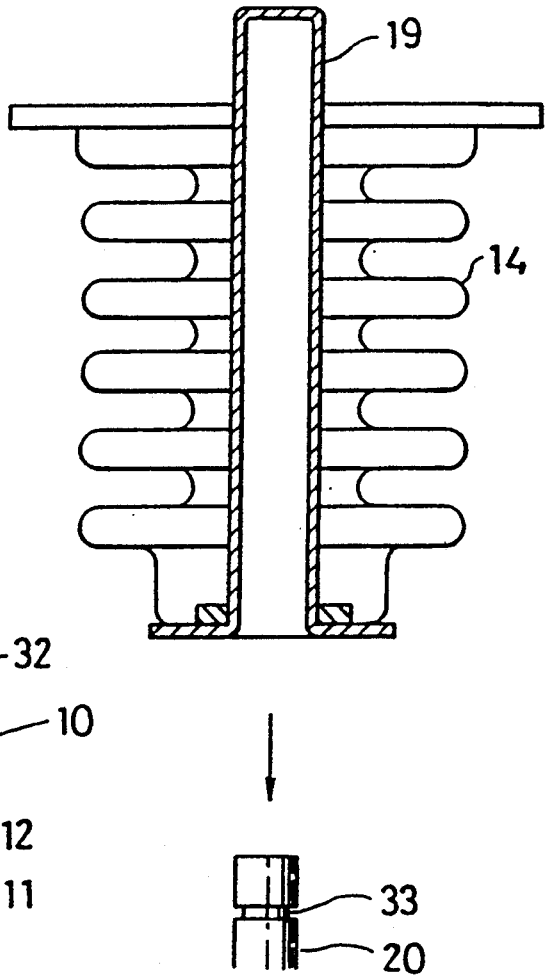
FIG. 3 is a fragmentary, vertically sectioned view as magnified of the means of FIG. 1.
Figure 2:
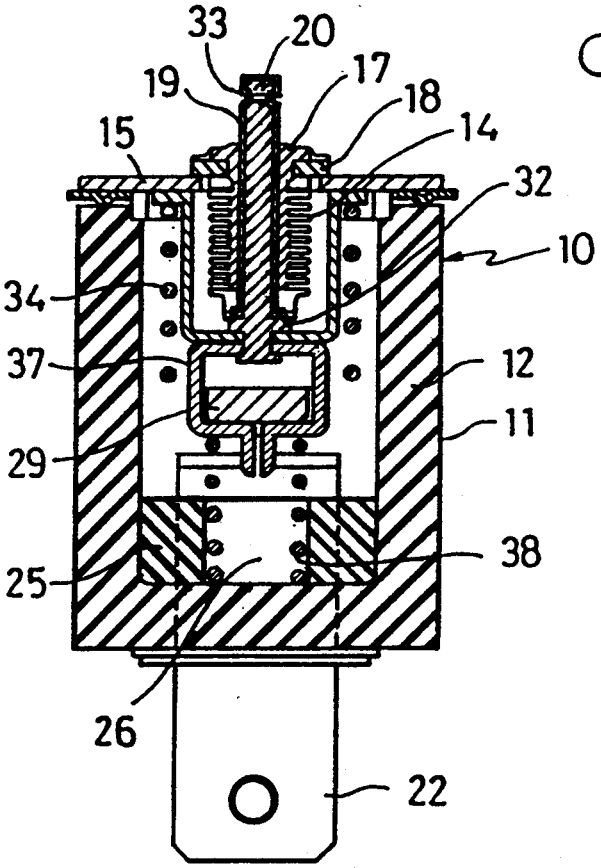
FIG. 2 is a vertically sectioned view also of the switching contact means of FIG. 1 but taken along a line rotated by 90 degrees from that of FIG. 1.

Referring to FIGS. 1 to 3, there is shown a switching contact means 10 to be employed in the sealed contact unit of the present invention in an assembly with a driving means which is later shown and described. This switching contact means 10 generally comprises a sealed container 11 which includes a container body 12 formed in a hollow box shape with such heatproof material as ceramics to be opened on one side and having in bottom wall a pair of through holes 13 and **13*a* for passing a pair of stationary contacting members later described, and a cover 15 having a bellows 14 mounted in air-tight manner to the cover and a ventilating hole 16 to which a feed pipe 16*a* is connected. The bellows 14 is mounted to a central opening made through the cover 15 plate-shaped, through a bellows holder 18 for air-tightly holding an upper end of the bellows 14 to peripheral edge of the opening, together with a centrally disposed shaft bearing 17**.

A movable shaft 20 passing through an elongated, bottomed cylindrical sleeve 19 is enclosed by the bellows 14 and air-tightly coupled at a corresponding open end to an inward end of the bellows 14. In this case, said sleeve 19 may be riveted and secured in an annular groove 33 provided at upper end part of said movable shaft 20 which is provided with a flange 32 at its lower end. The cover 15 is backed with a plate shaped insulating plate 21 formed by such heatproof material as ceramics, and is air-tightly secured to the open side of the container body 12, such electrically insulating gas as hydrogen gas or the like is fed through the feed pipe **16*a* into the interior of the container body 12 so as to be at a pressure of, for example, about 2 atm, and thereafter the pipe 16*a*** is closed.

The pair of the stationary contacting members 22 and **22*a* are formed preferably with a copper series plate material and are passed through the through hole 13 and 13*a* in the bottom of the container body 12 to be outside the container body 12 at one ends, while their other ends positioned inside the container body 12 are bent into L-shape as contact securing arms on which stationary contacts 23 and 23*a* are secured and further bent at their tip ends toward the bottom wall of the container body 12 so as to form horn parts 24 and 24*a*, and a support base 25 formed with such heatproof material as ceramics is interposed between the bottom wall of the container body 12 and the contact securing arms of the stationary contacting members 22 and 22*a*. In the center of the support base 25, there is provided a receiving hole 26 and, on both sides of this hole 26 a pair of through holes 27 and 27*a* for passing the stationary contacting members 22 and 22*a* for their reliable support. At the passing positions of the stationary contacting members 22 and 22*a* on the outer bottom face of the container body 12, sealing bottom plates 28 and 28*a* made preferably of 42 alloy or the like are secured air-tightly by means of a brazing or the like. If required, this support base 25 may be formed integrally with the bottom wall of the container body 12**.

A movable contacting member 29 is formed preferably with a copper series material to carry at both end parts thereof a pair of movable contacts 30 and **30*a*, and is disposed in the container body 12 to oppose the movable contacts 30 and 30*a* respectively to the stationary contacts 24 and 24*a* for engaging therewith and disengaging therefrom in a manner later described. Both ends of the movable contacting member 29 are respectively bent to be substantially symmetrical to the horn parts 24 and 24*a* of the stationary contacting members 22 and 22*a*, that is, in a direction separating from the stationary contacting members 22 and 22*a*, and horn parts 31 and 31*a* of the movable contacting member 29** are thereby formed.

A contact-pressure coil spring 34 which encloses therein the bellows 14 which further enclose therein the movable shaft 20 is provided between the movable contacting member 29 and the inner surface of the cover 15 fitted to the container body 12, so as to function as means for resiliently biasing the movable contacting member 29 against the stationary contacting members 22 and **22*a*. The contact-pressure spring 34 is preferably guided by a cup-shaped supporter 35 of a slightly smaller diameter than the spring 34. The supporter 35 of a bottomed cylindrical shape opened at top end has a peripheral flange 36 at the top open end, at which flange 36 the supporter 35 is fitted to the inner surface of the cover 15, while the lower end flange 32 of the movable shaft 20 is engaged with the bottom wall of the supporter 35 and the lower end of the movable shaft 20 is projected through and out of the bottom wall of the supporter 35. This projected end of the movable shaft 20 is interlocked and secured to a contacting member carrier 37 mounted to the central part of the movable contacting member 29. With such coaxially enclosing arrangement of the contact-pressure coil spring 34, cup-shaped supporter 35 and bellows 14 with respect to the movable shaft 20** as the center, the external size of the entire sealed contact unit can be effectively reduced.

Between a central part on lower side of the movable contacting member 29 and the central part of the bottom wall of the container body 12, a resetting coil spring 38 is disposed as guided at lower part of the spring 38 in the receiving hole 26 in the center of the support base 25 for the stationary contacting members 22 and 22*a*, so as to resiliently bias the movable contacting member 29 upward and away from the stationary contacting members 22 and 22*a*, against the biasing force of the contact-pressure spring 34.

While not shown in FIGS. 1 to 3, a magnet means for providing a magnetic field to the movable and stationary contacts in any known aspect per se can be employed, which means comprises a magnetic circuit device including a permanent magnet and yokes holding the magnet. In this case, the yokes are disposed outside the sealed container 11 so as to enclose the stationary contacts 23 and 23*a* as well as the movable contacts 30 and 30*a*, so that the magnetic field of a flux direction perpendicular to the moving direction of the movable contacting member 29 will be caused through a space in which the movable and stationary contacts 30, 30*a*, 23 and 23*a* are disposed. While also not shown in FIGS. 1 to 3, the driving means may be disposed adjacent to the sealed container 11 for switching operation of the movable contacts 30 and 30*a* with respect to the stationary contacts 23 and 23*a* through the sleeve 19 and movable shaft 20 projected out of the sealed container 11. Optimumly, this driving means comprises an electromagnetic device.

Referring here to the operation of the switching contact means in the embodiment of FIGS. 1 to 3, an axial inward action of the sleeve 19 and movable shaft 20 as pushed at their outer projected end by the driving means causes through the contacting member carrier 37 the movable contacting member 29 to be moved downward, and the movable contacts 30 and 30*a* come into contact with the stationary contacts 23 and 23*a*, upon which the biasing force of the contact-pressure spring 34 being applied to the movable contacting member 29 is effective to optimum provision of the contact pressure to the movable contacts 30 and 30*a* with respect to the stationary contacts 23 and 23*a*. When pushing force of the driving means to the movable shaft 20 is released, the movable shaft 20 and movable contacting member 29 are moved upward by the pressure of the sealed insulating gas in the container 11 and acting on the bellows 14 as well as the return biasing force of the resetting spring 38 acting on the movable contacting member 29, and the stationary and movable contacts 23, 23*a* and 30, 30*a* are thereby opened.

In the embodiment of FIGS. 1 to 3, the bellows 14 and contact-pressure spring 34 are disposed to enclose the movable shaft 20 to be coaxial therewith, whereby the switching contact means 10 can be sufficiently minimized in the height in the axial direction of the movable shaft 20. Further, any arc generated upon the opening action of the movable contacts 30 and 30*a* from the stationary contacts 23 and 23*a* is caused, by the action of the magnetic field of the magnet means, to shift sideward to gradually open spaces between the opposing horn parts 24, 31 and 24*a*, 31*a* of the stationary and movable contacting members 22, 22*a* and 29 to be sufficiently expanded to be optimumly extinguished. Further, the stationary contacting members 22 and 22*a* can be reliably positioned by means of the support base 25, in such that a difference in the coefficient of linear expansion of respective constituents due to a heat given upon brazing of the sealing bottom plates 28 and 28*a* to the bottom face of the container body 12 is utilized so that the stationary contacting members 22 and 22*a* heated will expand to be slightly thicker than the through holes 13 and 27 of the container body 12 and support base 25 due to the heat of brazing, but will contract when cooled to a normal temperature after solidification of soldering material for brazing the bottom plates 28 and 28*a* to secure them to the container body 12, to thereby fasten the bent parts carrying the stationary contacts 23 and 23*a* of the stationary contacting members against the support base 25. Therefore, any relatively large external force exerted upon the stationary contacting members 22 and 22*a* can be born by the support base 25, and this action can be maintained for a long time so that the stationary contacts 23 and 23*a* will involve no substantial positional shift and the unit can be sufficiently improved in the reliability.

Figure 4:
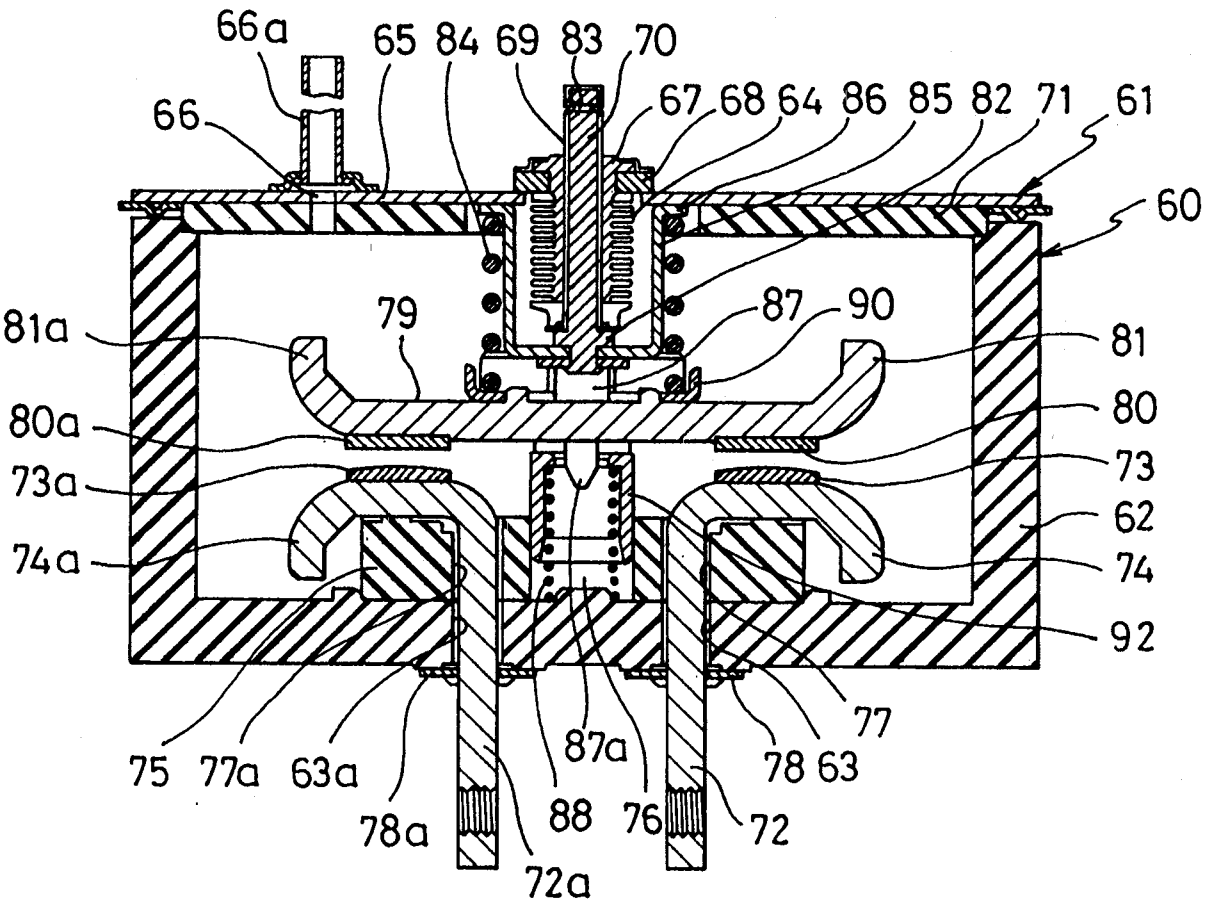
FIG. 4 shows in a vertically sectioned view another embodiment of the switching contact means employed in the unit according to the present invention.
Figure 5:
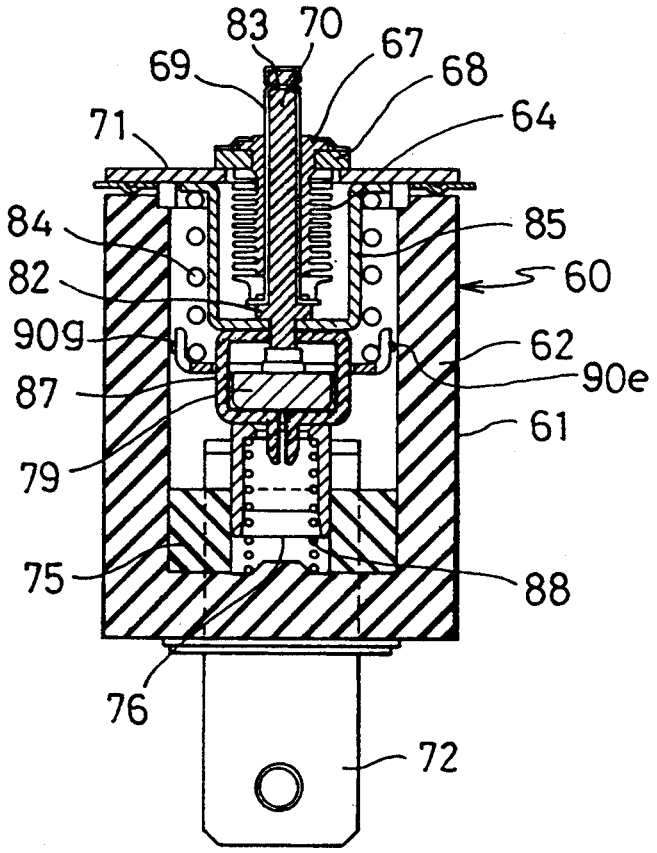
FIG. 5 is a vertically sectioned view also of the means of FIG. 4 but taken along a line rotated by 90 degrees from that of FIG. 4.
Figure 6:
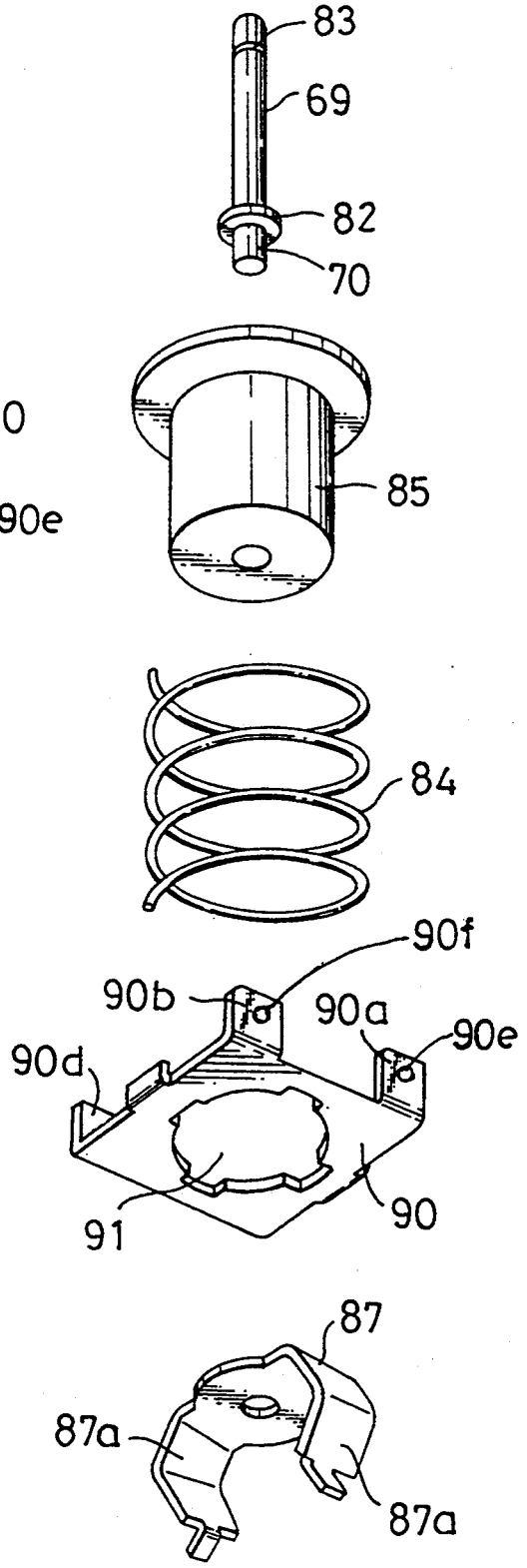
FIG. 6 shows in a perspective view as disassembled of members for movably supporting the movable contacting member in the means of FIG. 4.

Referring now to FIGS. 4 to 6 showing another embodiment of the switching contact means employed in the unit according to the present invention, there is provided a saucer 90 for receiving the lower end of the contact-pressure coil spring 84 at central part on top side of the movable contacting member 79. This saucer 90 is formed to have a central aperture 91 of a diameter smaller than that of the contact-pressure coil spring 84, and this aperture 91 has outer peripheral notches at angular intervals of, for example, 90 degrees into which corresponding projections provided on the top side in the central part of the movable contacting member 79 engage, whereby the saucer 90 can be placed on the movable contacting member 79 as prevented from rotating, so that any positional shift at the lower part of the contact-pressure spring 84 can be restrained by this saucer 90 and the spring 84 can be kept for functioning in stable attitude. If required, the saucer 90 may be provided at four corners with projections 90*a* to 90*d* positioned in close proximity to inner side walls of the container body 62 so that, in an event when the saucer 90 is happened to be rotated, the projections 90*a*–90*d* will hit the side wall of the container body 62 to stop the rotation. In this connection, it will be preferable to provide small hemispherical projections 90*e* to 90*h* to the projections 90*a*–90*d* on their side facing the side walls of the container body 62 so as to be more close to the side walls.

The contacting member carrier 87 mounted to the center of the movable contacting member 70 as interlocked to the lower end of the movable shaft 87 extends both leg parts 87*a* through the aperture 91 of the saucer 90 and over both sides of the contacting member 79 to embrace the same by these leg parts bent inward. A reverse cup-shaped supporter 92 made of an electrically insulating material for the resetting coil spring 88 is interlocked at top end to the bent leg parts 87*a* of the carrier 87 and houses therein the resetting spring 88 for biasing the movable contacting member 79 upward, while preventing any positional deviation of the spring 88 particularly at its top part for causing the spring to function in stable posture. Further, said resetting coil spring 88 is effectively protected by the supporter against any arc generated upon the opening action of switching contact means .

In the embodiment of FIGS. 4 to 6, other constituents are the same as those in the foregoing embodiment of FIGS. 1 to 3, and substantially the same constituents as those in FIGS. 1–3 are denoted in FIGS. 4–6 by the same reference numbers as those used in FIGS. 1–3 but with "50" added. With these same constituents, substantially the same functions as those in the embodiment of FIGS. 1–3 can be attained.

Figure 7:
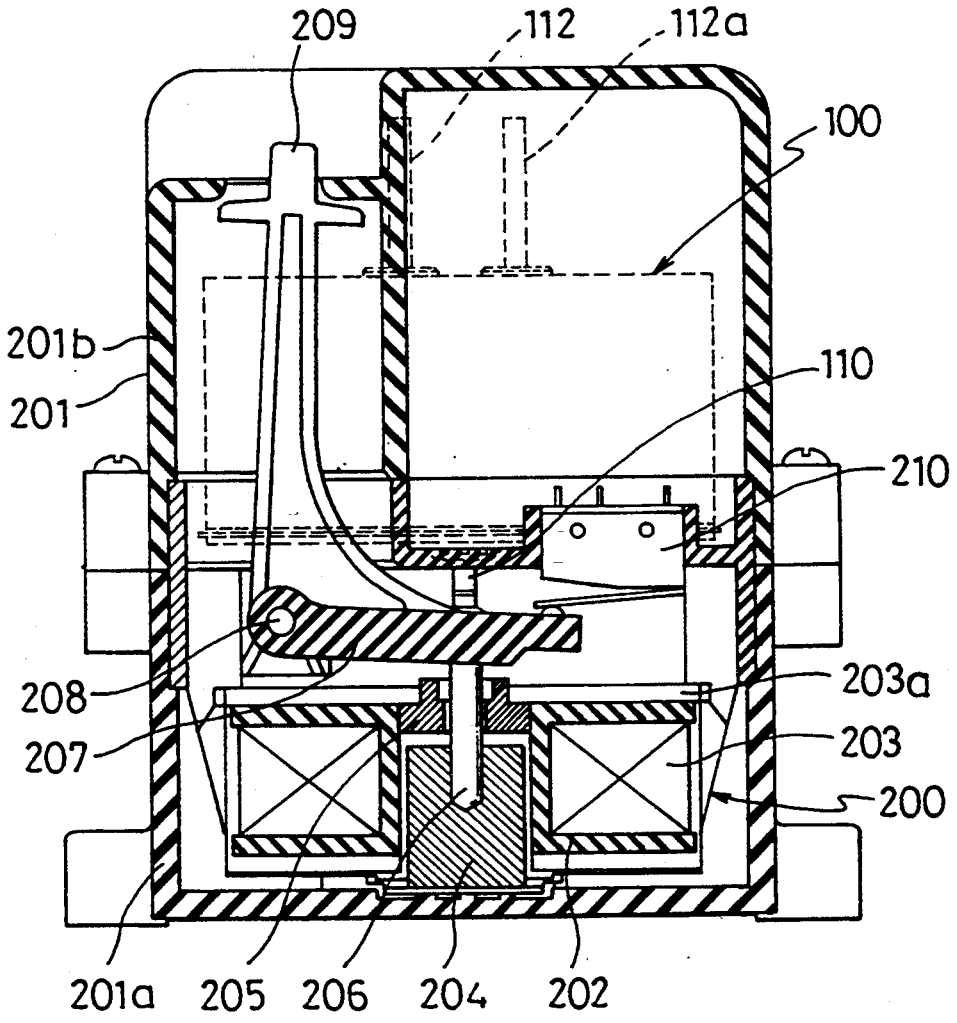
FIG. 7 shows in a vertically sectioned view an aspect of the sealed contact unit in which the switching contact means in the embodiment of FIGS. 1–3 or of FIGS. 4–6 and shown schematically with imaginary lines is assembled with a driving means.
Figure 8:
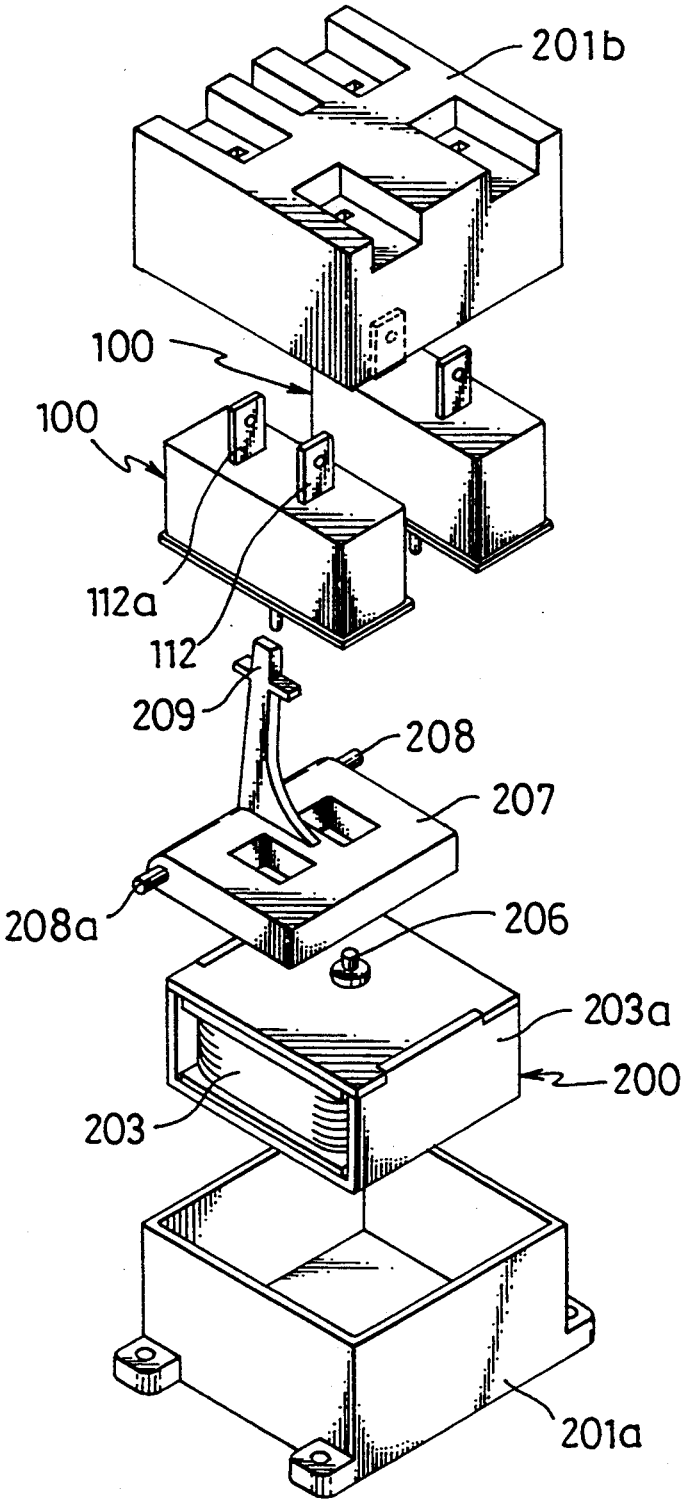
FIG. 8 is a perspective view as disassembled of the sealed contact unit of FIG. 7.

Referring now to FIGS. 7 and 8, there is shown an aspect of the sealed contact unit according to the present invention, in which a plurality of the switching contact means 100 are assembled with the driving means 200, the switching contact means 100 corresponding to the switching contact means 10 or 60 of the foregoing embodiment of FIGS. 1–3 or 4–6. On the other hand, the driving means 200 is housed, together with the switching contact means 100, in a casing 201 comprising lower and upper casing halves 201*a* and 201*b* mutually fittable to be integral. This driving means 200 comprises a coil bobbin 202 on which coils 203 are wound, a yoke 203*a* surrounding the coil bobbin 202, a movable core 204 of a columnar shape and disposed in axial hollow space of the coil bobbin 202, and a stationary core 205 disposed above the movable core 204 also in the axial space as coupled to the yoke 203*a*.

The projected end of the movable shaft 110 of the switching contact means 100 (shown in reversed state from that of FIGS. 1 or 4) is disposed for interlocking with an upper end of a driving pin 206 projected out of the stationary core 205 of the driving means 200, while a lower end of this driving pin 206 passed through the stationary core 205 is coupled to the movable core 204 for axial movement therewith. An intermediate movable member 207 is interposed between both projected ends of the movable shaft 110 of the sealed contact means 100 and of the driving pin 206 of the driving means 200, and this intermediate movable member 207 generally plate-shaped has mutually oppositely projecting pivot pins 208 and 208*a* on one side to be born by side walls of the lower casing half 201*a* for rendering the other side to be rockable about the pins 208 and 208*a* as a fulcrum, and an indicating arm 209 erected from central part of the one fulcrum side of the member 207 the extend upward to be exposed at top end out of the upper casing half 201*b*.

In addition, the ends of the stationary contacting members 112 and 112*a* projected out of the container body of the switching contact means 100 are disposed to be also projected out of the upper casing half 201*b*, so as to act as stationary contact terminals. Within the casing 201, preferably, a limit switch 210 is disposed to be actuated for switching operation in response to the rocking of the intermediate movable member 207 so as to provide corresponding signals to the exterior.

When in the aspect of FIGS. 7 and 8 the coils 203 are excited, the movable core 204 of the driving means 200 is attracted from its non-excited position shown in FIG. 7 towards the stationary core 205, and the driving pin 206 coupled to the movable core 204 is moved upward as guided by a through hole of the stationary core 205, upon which the rockable side of the intermediate movable member 207 is urged upward by the upper end of the driving pin 206 so as to rock upward with the pivot pins 208 and 208*a* as fulcrum. Accompanying this rocking, the movable shafts 110 of the switching contact means 100 are pushed inward into the sealed containers, and the contact closing operation can be executed in the manner described with reference to FIGS. 1–3 or 4–6. In the present aspect, the single intermediate movable member 207 is adapted to concurrently actuate the two switching contact means 100, and this number is not required to be limited to be two. Accompanying the rocking motion of the intermediate movable member 207, the limit switch 210 is also actuated to transmit the operational signals to such external device as a circuit controller. With the rocking motion of the intermediate movable member 207, further, the indicating arm 209 concurrently rocking to shift position of the exposed top end allows the operation of the driving means 200 and eventually the switching position of the switching contact means 100 to be visible from the exterior.

According to the foregoing arrangement, the interlocking of the movable shafts 110 of the switching contact means 100 to the driving pin 206 of the driving means 200 with the interposition of the intermediate movable member 207 is effective to attain a reliable pushing action in the axial direction of the movable shafts 110 of the switching contact means 100 by the intermediate movable member 207 even in the case where a positional deviation is involved between the switching contact means 100 and the driving means 200 due to any manufacturing tolerance of these means. In this event, the movable shaft 110 is made to smoothly axially move as guided, for example, by the bearing 17 as shown in the embodiment of FIGS. 1–3, eventually the switching operation of the contacts can be also performed in stable manner, and the sealed contact unit can be also improved in the reliability of the entire unit.

In the present invention, further, the sealed contact unit can be modified variously within the scope of the appended claims. For example, the respective means and their constituents denoted by the terms "upper" and "lower" in conformity to their positions shown in the drawings, but they may be employed in even in reversed state, or at rotated position in any direction or by any angle, for example, 90 degrees, without causing any influence to be given on the operation.

What is claimed is:

1. A sealed contact unit comprising:

a switching contact section including a box-shaped sealed container defining therein an air-tightly sealed space containing an electrically insulating gas sealed therein, a movable shaft axially movably passed through a wall of said container with a bellows mounted at one end inside said wall of the container for air-tightly, coaxially holding said movable shaft, with an end of the shaft disposed inside said container and coupled to the other inner end of said bellows and with the other end of the shaft projecting outside the container, a stationary contacting member secured to another wall of said container opposite said wall having said movable shaft and carrying stationary contacts secured to an end of said stationary contacting member disposed inside the container, a movable contacting member disposed inside said container to be between said movable shaft and said stationary contacting member, said movable contacting member carrying movable contacts secured thereto to oppose said stationary contacts of the stationary contacting member and being interlocked through a carrier means to an inner end of said movable shaft, a contact-pressure coil spring disposed coaxially with said movable shaft and bellows for biasing said movable contacting member in a direction of closing said movable and stationary contacts, and a resetting spring disposed between said movable contacting member and said opposite wall of said container for normally biasing said movable contacting member in a direction of opening said movable and stationary contacts; and a driving section disposed outside said sealed container of said switching contact section and connected to said other projected end of said movable shaft of said switching contact section for switching, upon being actuated, urging the movable shaft inward against said resetting spring to shift the movable contacting member toward the stationary contacting member to close said movable and stationary contacts.

2. The unit according to claim 1, wherein said stationary contacting member is formed in an L-shape of which a bent portion disposed within said sealed container carries said stationary contacts, and said contact-carrying bent portion of the stationary contacting member is supported by a support base disposed between the bent portion and said opposite wall of said container.

3. The unit according to claim 1, wherein said switching contact section further includes a sleeve opened at one end to insert into said sleeve said movable shaft, said sleeve being air-tightly coupled at said open end of said sleeve to a corresponding end of said bellows.

4. The unit according to claim 1, wherein said switching contact section further includes a saucer disposed to flatly engage a central part of said movable contacting member for receiving an end of said contact-pressure spring, said saucer being positioned to be in close proximity to the inner side wall of said sealed container.

5. The unit according to claim 1, wherein said switching contact section further includes a supporter disposed inside said container on said opposite wall to enclose therein said resetting spring.

6. The unit according to claim 1, wherein a plurality of said switching contact sections are contained in a unit housing, said driving section comprises an electromagnetic driving member contained in said unit housing, said driving member including an excitation coil means, a movable core enclosed by said coil means for shifting under electromagnetic excitation of said coil toward and away from a stationary core secured to an axial end of the coil means, said movable core having a drive pin protruding out of said coil means, and an intermediate movable member interposed between a protruded end of said drive pin and a plurality of said protected ends of said movable shafts of the switching contact sections for transmitting a force of said urging of the drive section commonly to said plurality of the switching contact sections.

7. The unit according to claim 6, wherein said intermediate movable member is pivotably supported on one end side by a pivot pin borne by said unit housing for interposition on the other rockable end side between said drive pin of said driving section and said movable shafts of said plurality of switching contact sections.

8. The unit according to claim 6, wherein said intermediate movable member is provided with an indicating arm extended from the intermediate movable member to have an end rockable together with said rockable end side of the intermediate movable member and disposed to be visible from the exterior of said unit housing for indicating ON/OFF positions of said contacts with rocked positions of said rockable end.

9. The unit according to claim 6, which further comprises means responsive through said intermediate movable member to said actuation of said driving section for generating signals corresponding to the actuation to be transmitted to the exterior.

* * * * *